US007254970B2

(12) United States Patent
Buss et al.

(10) Patent No.: US 7,254,970 B2
(45) Date of Patent: Aug. 14, 2007

(54) LAUNDRY TREATMENT MACHINE

(75) Inventors: Karl-Heinz Buss, Stuttgart (DE); Gerd Maentele, Urbach (DE); Andreas Bollmann, Adelberg (DE); Yvonne Sellmer, Koengen (DE)

(73) Assignee: Whirlpool Corporation, Benton Harbor, MI (US)

( * ) Notice: Subject to any disclaimer, the term of this patent is extended or adjusted under 35 U.S.C. 154(b) by 596 days.

(21) Appl. No.: 10/639,660

(22) Filed: Aug. 12, 2003

(65) Prior Publication Data

US 2004/0088881 A1 May 13, 2004

(30) Foreign Application Priority Data

Aug. 13, 2002 (DE) ..... 102 37 017

(51) Int. Cl.
*D06F 39/14* (2006.01)

(52) U.S. Cl. ..... 68/196; 34/601

(58) Field of Classification Search ..... 68/196; 34/601

See application file for complete search history.

(56) References Cited

U.S. PATENT DOCUMENTS 3,330,137 A * 7/1967 Ketter ..... 68/23.7
3,581,527 A * 6/1971 Smith et al. ..... 68/26
3,742,736 A * 7/1973 Fish et al. ..... 68/23.5
4,112,590 A * 9/1978 Muller ..... 34/75
5,860,300 A * 1/1999 Valent ..... 68/24
2004/0187223 A1* 9/2004 Clark ..... 8/158

FOREIGN PATENT DOCUMENTS

GB 2114606 A 8/1983
GB 2216906 A 10/1989
GB 2296018 A 6/1996
WO 0212612 A1 2/2002
WO WO 0212612 A1 * 2/2002

* cited by examiner

*Primary Examiner*—Michael Barr
*Assistant Examiner*—Sarah E. Husband
(74) *Attorney, Agent, or Firm*—John F. Colligan; Michael D. Lafrenz; Clifton Green

(57) ABSTRACT

The invention relates to a laundry treatment machine, more especially a washing machine or a laundry dryer, comprising a drivable drum which accommodates laundry and is rotatably mounted in a container integral with the housing, wherein the container is provided with an elastic sleeve, covering the transition from the front opening of the container to the housing opening, around the filler opening of the drum, and wherein a laundry rejector is attached in this transitional region in the region of the top dead center of the drum. For improvement purposes, a specially configured laundry rejector is provided in the region of the top dead center of the drum in conjunction with a receiving means in the sleeve in order to avoid laundry items from becoming damaged.

15 Claims, 1 Drawing Sheet

LAUNDRY TREATMENT MACHINE

BACKGROUND OF THE INVENTION

1. Field of the Invention

The invention relates to a laundry treatment machine, more specifically a washing machine or a laundry dryer, comprising a drivable drum which accommodates laundry and is rotatably mounted in a container integral with the housing. The container is provided with an elastic sleeve, covering the transition from the front opening of the container to the housing opening and around the filler opening of the drum. A laundry rejector is attached in the transitional region at the top center of the drum.

2. Description of the Related Art

In laundry treatment machines, more and more demands are being made on the laundry holding capacity of the machine. These demands lead to the dimension between the bottom of the drum and the lower region of the filler door becoming smaller and smaller with larger filler doors. The lower region of the filler door and that of the sleeve often lie on the same plane. This means that the laundry does not always slide back fully into the drum during the rotary movement of the drum and more specifically during the run-up thereof. Rather some of the laundry passes to the fixed sleeve and can be entrained there. In such cases the laundry can be damaged by the edge which forms the filler opening of the drum.

Therefore it is important to keep laundry away from the sleeve until a safe speed of the drum is reached.

SUMMARY OF THE INVENTION

One object of the present invention is to provide a laundry treatment machine that comprises a laundry rejector configured to keep laundry away from the sleeve. The laundry treatment machine being configured to minimize any damage to laundry even with a large quantity of laundry being inserted into the machine.

This object may be achieved, according to the invention, by incorporating a laundry rejector having a rigid mounting part to the front opening of the container. The laundry rejector may further comprise an elastic rejector part, which is introduced into a filler opening of the drum so as to form a gap between the mounting part and the drum. The sleeve has, in the region of the laundry rejector, a receiving means which is directed towards the housing opening, for receiving the mounting part of the laundry rejector and for permitting the insertion of the rejector part into the filler opening of the drum.

One of the advantages of providing a laundry rejector is eliminating some of the problems which may occur during run-up of the speed of the drum. For example, the rigid mounting part of the rejector allows specific securement on the container and such securement does not change. The elastic rejector part which may be attached to the mounting part, protrudes into the filler opening of the drum and may have sufficient deflectability to loosen tangled laundry items. Accordingly the problems which occur during the run-up to the speed of the drum may be overcome.

One of the most suitable places for attaching the laundry rejector is achieved when the laundry rejector is shifted forward in the rotating direction by approximately 15° with respect to the top center of the drum. In this way the maximum force of gravitation is opposed to the centrifugal force which allows both forces to act upon the laundry, and assists the rejecting process at the laundry rejector.

According to one embodiment, the securement of the laundry rejector on the container is achieved so that the mounting part of the laundry rejector is attached, preferably screw-connected, to a radially outwardly directed mounting flange of the container in the region of the front opening of the container.

The laundry rejector is provided with a wider configuration to improve the rejector function. In particular, the rejector part of the laundry rejector extends over a part of the perimeter of the filler opening of the drum and is adapted with its width to the curvature of the inner wall of the filler opening. The rejector part with respect to its width protrudes with a variable depth of insertion into the filler opening of the drum. In such case, provision is preferably made for the immersion depth of the rejector part to increase in the direction of rotation of the spinning operation of the drum.

The laundry rejector, which can be manufactured in a particularly economical manner, can be obtained when the mounting part is substantially plate-shaped and is in the form of a plastics material injection-moulded part, and when the rejector part is injection-moulded, via a holding flange, on the mounting part in a perpendicularly projecting manner. This embodiment may also prevent the laundry from becoming tangled on the rejector.

BRIEF DESCRIPTION OF THE DRAWINGS

The invention is explained more fully with reference to one embodiment illustrated in the drawing. In the drawing.

DETAILED DESCRIPTION

Figure 1:
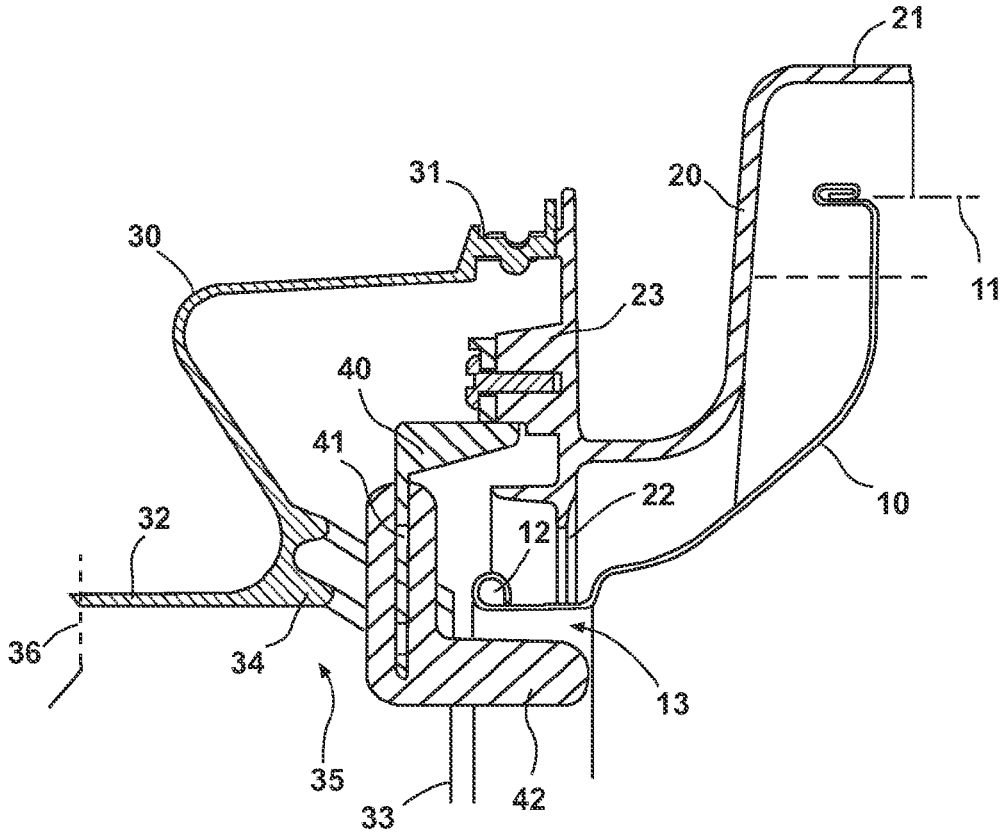
FIG. 1 is a partial vertical sectional view in the region of the top center of the drum and in the region of the transition from the filler opening of the drum to the housing opening, which transition is covered by a sleeve.

The cross-sectional view in FIG. 1 shows the upper front region of the drum 10, the drum wall 11 of which is held in an end part forming the filler opening 12 with a reduced diameter. This drum 10 is rotatably mounted in the closed rear part of a container 20 in known manner. This container 20 is integral with the housing and surrounds the drum 10 at a spacing therefrom, as the container wall 21 shows. These parts and their function do not need to be described more fully in connection with the present invention. It should only still be mentioned that the holding capacity of the drum 10 has been increased more and more, and that today appliances are quite commonplace which have a quantity of laundry to be inserted of up to about 9 kg or about 20 lbs.

The front end part of the drum 10 protrudes through the front opening 22 of the container 20. A radial mounting flange 23 extends radially outwardly in the region of the front opening 22 and allows the mounting of an elastic sleeve 30 which is attached, via an intermediate part 31, to the mounting flange 23. This intermediate part 31 can also only be attached in the region of the laundry rejector 40 provided at the front opening 22, so that a receiving means 35 for the laundry rejector 40 is formed and extends towards the housing opening 36, said rejector extending only over a part of the perimeter of the filler opening 12 of the drum 10. Then the sleeve 30 can also abut directly against the mounting flange 23 externally of the intermediate part 31 and can be fixed.

FIG. 1 only indicates that the other side of the casing-like sleeve 30 is fixed at the housing opening 36 so that the transition from said opening to the filler opening 12 of the drum 10 is covered apart from a gap which is shown by the ends 33 of the lips 34 at the sleeve 30 and the filler opening 12.

The laundry rejector 40 is composed of a rigid mounting part 41 and an elastic rejector part 42. The mounting part 41 is substantially plate-shaped and is in the form of a plastics material injection-moulded part and can be screwed tightly on the mounting flange 23 of the container 20. The mounting part 41 is connected to the rejector part 42 which, in the simplest way, can be injection-moulded on the mounting part 41. In such case, the rejector part 42 protrudes perpendicularly from the mounting part 41.

Figure 2:
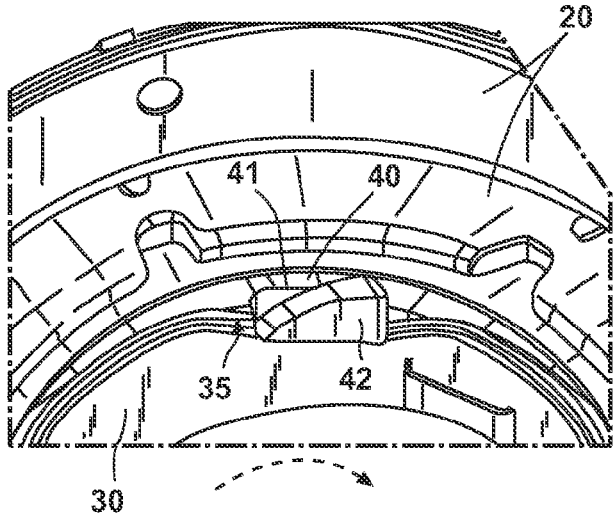
FIG. 2 is a partial rear view of the mounting point with the laundry rejector, seen from the drum.

As shown in FIG. 2, the sleeve 30 facing the drum 10 forms the receiving means 35 which provides space for the mounting part 41 with the injection-moulded rejector part 42. Because the laundry rejector 40 only extends over a part of the perimeter of the filler opening 12, the receiving means 35 on both sides of the laundry rejector 40 can be omitted again, and the sleeve 30 can be brought closer to the filler opening 12 so that there between only an indicated gap is formed (lips 34 and filler opening 12).

In the receiving means 35, at a spacing from the lips 34, the laundry rejector 40 provided with the injection-moulded rejector part 42 extends radially inwardly and projects with the perpendicularly protruding rejector part 42 into the filler opening 12 of the drum 10 so as to form a gap 13.

As shown in FIG. 2, the rejector part 42 has a limited width which determines the width in the circumferential direction of the receiving means 35 of the sleeve 30. The free end of the rejector part 42 is sufficiently elastic, despite a relatively large thickness, to execute deflection movements which are needed for the loosening of tangled laundry items. In such case, the width of the rejector part 42 is adapted to the curvature of the filler opening 12, and the rejector part 42 has a variably large depth of immersion into the filler opening 12 of the drum 10, this depth being so adapted to the rotating direction of the drum 10 that it increases in the rotating direction of the spinning operation. In consequence, an optimum rejecting action can be achieved because the laundry items are urged away towards the drum 10.

The laundry rejector 40 is disposed in the region of the top dead center of the drum 10, namely it is preferably shifted forward in the rotating direction of the drum 10 by about 15°, since a maximum proportion of the gravitation force thus counteracts the centrifugal force of the laundry so that the rejection of laundry items at the laundry rejector 40 is thereby assisted. In such case, the immersion depth of the rejector part 42 increases in the rotating direction during the spinning operation to improve the rejecting action. Therefore, it is important for the laundry rejector 40 to come into contact with the laundry items, if the latter have already passed the top dead center during the spinning operation. The distance in the circumferential direction is selected to be approximately 15°.

We claim:

1. Laundry treatment machine, comprising:

a drivable drum adaptable to accommodate laundry and is rotatably mounted in a container integral with a housing, the container being provided with an elastic sleeve configured to cover a transitional region from a front opening of the container to the housing and around a filler opening of the drum; and a laundry rejector having a rigid mounting part attached to the front opening of the container inside an attachment point of the elastic sleeve to the container and an elastic rejector part, which is introduced through an open space between the container, the filler opening and the elastic sleeve and into the filler opening of the drum so as to form a gap.

2. The laundry treatment machine according to claim 1, wherein the mounting part of the laundry rejector is attached to a radially outwardly directed mounting flange of the container in the region of the front opening of the container.

3. The laundry treatment machine according to claim 1, wherein the rejector part of the laundry rejector extends over a part of the perimeter of the filler opening of the drum and is adapted with its width to the curvature of the inner wall of the filler opening.

4. The laundry treatment machine according to claim 3, wherein the rejector part with respect to its width protrudes with a variable depth of insertion into the filler opening of the drum.

5. The laundry treatment machine according to claim 4, wherein the immersion depth of the rejector part increases in the direction of rotation of the spinning operation of the drum.

6. The laundry treatment machine according to claim 5, wherein the mounting part is substantially plate shaped and is in the form of a plastics material injection-moulded part, and in that the rejector part is injection-moulded, via a holding flange, on the mounting part in a perpendicularly projecting manner.

7. A laundry treatment machine, comprising:

a housing defining an interior;

a drivable drum adaptable to accommodate laundry, the drum having a filler opening on one end;

a container located within the interior and surrounding the drivable drum, the container includes an opening permitting access to the drum filler opening;

a transitional region formed between the container opening and the housing;

a sleeve covering the transitional region around the filler opening of the drum; and a laundry rejector having an elastic rejector part and a rigid mounting part, the rigid mounting part attached to the container internal to an attachment point of the sleeve to the container and the elastic rejector part extending through an open space between the container, the drum filler opening and the sleeve and into the drum filler opening.

8. The laundry treatment machine according to claim 7, wherein the mounting part of the laundry rejector is attached to the container in the region of the container opening.

9. The laundry treatment machine according to claim 7, wherein the rejector part of the laundry rejector is inserted in the top section of the drum filler opening.

10. The laundry treatment machine according to claim 7, wherein the rejector part of the laundry rejector extends over a part of the perimeter of the drum filler opening and is adapted with its width to the curvature of the inner wall of the drum filler opening.

11. The laundry treatment machine according to claim 7, wherein the rejector part of the laundry rejector has a width that protrudes with a variable depth of insertion into the drum filler opening.

12. The laundry treatment machine according to claim 10, wherein the immersion depth of the rejector part increases in the direction of rotation of the spinning operation of the drum.

13. A laundry treatment machine, comprising:

a drivable drum adaptable to accommodate laundry, the drum having a filler opening on one end;

a housing containing the drivable drum, the housing includes an opening permitting access to the drum filler opening;

a container surrounding the drivable drum and surrounded by the housing, the container includes an opening permitting access to the drum filler opening;

a sleeve configured to cover a transitional region from the container opening to the housing opening and attached to the container around the filler opening of the drum, the sleeve includes a receiving means portion, which is directed toward the housing opening and is adapted to allow for attaching a rigid mounting part of a laundry rejector to the container internal to an attachment point of the sleeve to the container, an elastic part of the laundry rejector extending through a space between the container, the drum filler opening and the sleeve and into the drum filler opening; and the laundry rejector extending over a portion of the drum filler opening perimeter and extending into the drum filler opening.

14. The laundry treatment machine according to claim 13, wherein the laundry rejector with respect to its width protrudes with a variable depth of insertion into the filler opening of the drum.

15. The laundry treatment machine according to claim 14, wherein the immersion depth of the laundry rejector increases in the direction of rotation of the spinning operation of the drum.

* * * * *